US005363082A

United States Patent [19]

Gurevich

[11] Patent Number: 5,363,082

[45] Date of Patent: Nov. 8, 1994

[54] FLIP CHIP MICROFUSE

[75] Inventor: Leon Gurevich, Grover, Mo.

[73] Assignee: Rapid Development Services, Inc., Ellisville, Mo.

[21] Appl. No.: 141,575

[22] Filed: Oct. 27, 1993

[51] Int. Cl.[5] ..... H01H 85/143

[52] U.S. Cl. ..... 337/227; 337/231; 337/260

[58] Field of Search ..... 337/186, 213, 201, 227, 337/231, 232, 234, 260, 262, 263, 297; 29/623

[56] References Cited

U.S. PATENT DOCUMENTS 3,500,276 3/1970 Hingorany .
4,547,830 10/1985 Yamauchi .
4,563,666 1/1986 Borzoni .
4,608,548 8/1986 Borzoni ..... 337/231
4,612,529 9/1986 Gurevich et al. .
4,873,506 10/1989 Gurevich .
5,130,688 7/1992 Van Rietschoten et al. .
5,140,295 8/1992 Vermot-gaud et al. .
5,166,656 11/1992 Badihi et al. .

*Primary Examiner*—Lincoln Donovan
*Attorney, Agent, or Firm*—Paul M. Denk

[57] ABSTRACT

A flip chip Surface Mount Fuse is disclosed. This fuse is comprised of a generally rectangular insulating member having a groove across its full length. A fuse element is placed inside the elongated groove and thick film metallizations are provided, through printing techniques, on opposite sides of the insulating member inside the groove to secure the fuse element and to provide termination to the insulating member. The opening of the groove is filled with an electrically insulating coating. The coating can be applied to form a time delay fuse or a fast acting fuse. Fuses can be manufactured in any desired size.

24 Claims, 2 Drawing Sheets

FLIP CHIP MICROFUSE

BACKGROUND OF THE INVENTION

The present invention is directed to improvements in microelectronic fuses and relates to surface mountable fuses employing only a single insulating member or chip, that can be directly soldered to a PC board.

Surface Mount Devices (SMDs) may be soldered directly to circuit boards and are preferred for use in circuit board mountings over through-hole axial devices. The surface attachment technology increases the packaging density and lowers the manufacturing and product cost. A unique characteristic of surface mounting is the ability for the chip and packaged components to be attached to both the component and solder sides of the board. The use of SMDs is becoming popular in consumer electronics.

The incorporation of the SMDs into all types of electronic devices created a need for SMD fuses. Surface mount fuses are used to prevent damage to electrical systems, caused by excessively large currents. The failure of a fuse can result in a fire or loss of costly equipment. It is conventional practice to employ a surface mount fuse in PC board circuits for protection from such excessively large currents.

There are several types of chips available for surface mounting. A first type is a wrap-around that has metallization around the full surface of the opposite ends of a rectangular chip. Another type, the flip chip, is terminated with metallization on a bottom side of the chip. There are also two types of internal constructions generally known for surface mount fuses. The first type is comprised of a thin wire fuse element spaced between two metal terminals. The wire is placed above the surface of the insulating body and connected to the leads or terminals by soldering, resistance welding, or wire bonding techniques. The complete device is enclosed in a plastic casing fabricated from thermoplastic materials by using injection molding techniques or by securing a cover to the base which encloses the fuse. Use of additional parts to provide for termination and enclosure to the fuse adds to the manufacturing complexity and ultimately to the cost of the fuse.

U.S. Pat. Nos. 5,162,773 to Shiozaki, 5,130,688 to Van Rietchoten, 4,612,529 to Gurevich et al., 4,547,830 to Yamauchi, 4,873,506 to Gurevich, 3,500,276 to Hingorany et al., 5,140,295 to Vermot-gaud et al., 5,166,656 to Badihi et al., and 4,563,666 to Borzoni all show variations of such a fuse. These patents disclose surface mount fuses with fuse elements comprised of a metal wire attached to prefabricated terminals by different means such as soldering, brazing, electrical or ultrasonic welding. The fuse elements are secured to the surface of the base, and thus must be enclosed by a sleeve, cover, or other enclosure to protect the PC board and the other components from the heat produced by the fuse elements, and the effects of the fuse if it should fail.

Thermoplastic materials often are used for the sleeve, body, and/or cover of the fuse. The thermoplastic materials are generally low temperature material which can melt and fail from temperatures above 300° C. However, fuse elements can generate these temperatures during prolonged openings at low overloads. The use of these materials can thus lead to fuse failure.

A second type of SMD fuse is comprised of the thin or thick film elements deposited on the surface of a substrate using thin or thick film printing or sputtering techniques. These fuses have larger variances in their characteristics due to inability of the deposition techniques to provide consistency of the thickness. Thick film printing generally can provide control only within 30% of the expected value, and thin film deposition, without additional processing, generally can provide control only within 15% of the expected value. By adding substantial cost to photolithographic techniques, thin film printing or spottering can be improved to be within 5% of the expected value. The higher accuracy of the cross sectional area of conductor and its length is required to obtain repeatable fuse performance. These fuses have the disadvantage of being expensive to produce accurately.

The second kind of fuse also has a large surface contact area between the deposited metallized coating and the insulating member. The larger contact area can cause the heat generated by resistance heating of the fuse element to be conducted to the substrate material at a rate directly proportional to its size. This may delay the opening of the fuse and lead to device overheating. Excessive overheating of the fuse may cause a melting of the solder joints holding the fuse in place. The fuse may disconnect from the board and cause arcing external to a fuse joint. Overheating may result in damage of the PC board material in close proximity to a fuse and diffusion of the thin film terminations into the molten solder which may result in premature opening of the fuse.

There are numerous variations of the two types described, however all such varieties have drawbacks to a greater or lesser degree.

SUMMARY OF THE INVENTION

One object of the present invention is to provide a microchip fuse which may be secured directly to a PC board.

Another object is to provide such a fuse which can withstand high temperatures.

Another object of this invention is to provide such a microchip fuse which includes insulating material with high insulating properties, high dielectrical strength, high arc resistance, which is nonflammable, and which can withstand temperatures above 300° C.

Another object is to provide a method to produce such a microchip fuse which has a highly accurate cross-sectional area.

Another object is to provide a fuse made of a minimum number of elements.

Another object is to provide such a microchip fuse which is leadless and uses a preformed conductor as a fuse element.

Another object is to provide such a fuse which is reduced in size and cost and is made of a reduced (preferably only two) number of prefabricated components.

These and other objects will become apparent to those skilled in the art in light of the following disclosure and accompanying drawings.

Briefly stated, a fuse of the present invention includes a fuse body made of an electrical insulating material. A groove extending between two opposite edges of the body is formed therein. The groove has a depth of less than 0.20" and preferably about 0.016". It has a width of between 0.004" and 0.32" and preferably a width of 0.006". A fuse element is received in the groove and placed near the bottom thereof. The fuse element is formed as a wire or ribbon made of copper, silver, platinum, gold, palladium, rubidium, nickel, aluminum, tungsten and their alloys. Spaced metal fillings are provided at opposite ends of the groove to form terminations for the fuse and to secure the fuse element in place in the body. The fillings extend across the top of the fuse body, but can extend around the outer edges of the body to provide for a wrap-around termination. A dielectric seal is provided between the terminations to close the groove. The seal can be spaced from the fuse element to provide for a time delay fuse, or can encapsulate the fuse element to provide for a fast acting fuse.

The terminations are made from a thick paste metallic ink which is printed, preferably by screen printing techniques, onto the fuse body. The ink is dried at between 120° C.–150° C. to evaporate solvents in the ink without boiling the ink. The body with the dried ink is then fired at temperatures exceeding 650° C. At these temperatures, the metallic ink sinters and bonds to the fuse element and the fuse body to provide a secure attachment of the elements of the fuse.

The fuse of the present invention, as can be appreciated consists only of a single body element and a single fuse element. No terminal pieces are required, reducing the number of parts needed for the fuse to two from four or more parts. The method of providing the terminations also secures the fuse element in place. Thus no soldering operations are needed. Because the fuse uses a minimum amount of parts and materials and because all soldering steps have been eliminated, the ease of manufacturing even small fuses has been increased and the cost of manufacture has been reduced.

DETAIL DESCRIPTION OF THE PREFERRED EMBODIMENT

Figure 1:
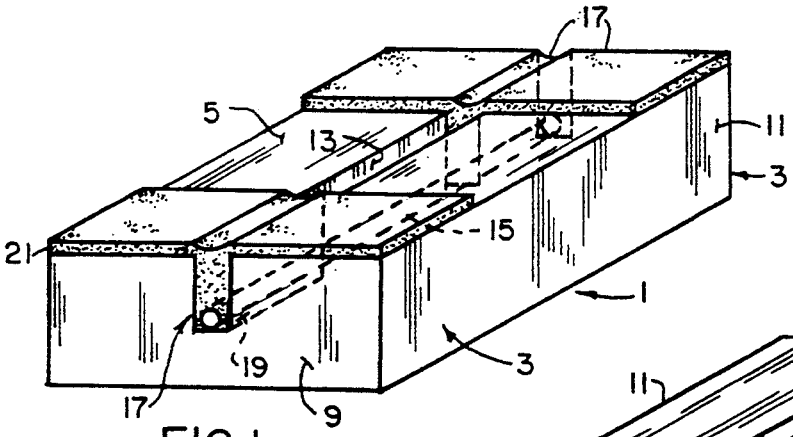
FIG. 1 is a perspective view of a flip-chip microfuse of the present invention.
Figure 2:
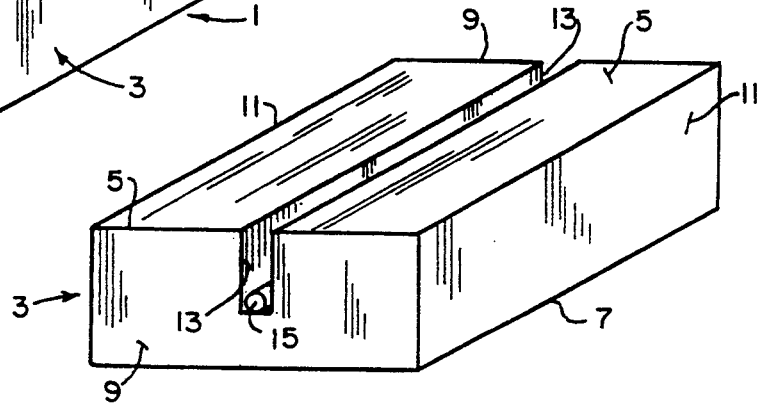
FIG. 2 is perspective view of a body of the fuse with a fuse element therein.

A fuse 1 of the present invention is shown in FIG. 1. Fuse 1 has s body 3 made of a dielectric, insulating material. Preferably, body 3 is made of ceramic or glass, and preferably of alumina and silica. Because of their susceptibility to heat, thermoplastics are not used in the fuse. The material for the body is selected for its high temperature characteristics. The body must withstand temperatures above 500° C., be a good electrical insulator, have high arc resistance, and provide good adherence for the thick film coatings such as metallization and dielectric coatings. A 96% alumina substrate which can be purchased from Coors Co of Colorado or GE Ceramic Materials Division is the preferred material for the body.

Body 3 is preferably rectangular and has a top 5, bottom 7, front and back walls 9, and side walls 11. The substrates, from which the body is formed, can be obtained in sizes varying from 0.5"×0.5" to 6"×6". The body 3 is formed from the substrate by dicing or hot pressing techniques to have a thickness of 0.040", from top to bottom, a length of 0.120", and a width of 0.060".

A groove 13 is formed in body top 5 which spans the length of the body 3. Groove 13 is less than 0.20" deep and preferably not more than 0.016" deep. Most preferably, the groove is 0.012" deep. The groove may be between 0.004" and 0.20" wide. Preferably, the groove is 0.006" wide.

A thin wire fuse element 15 is placed inside groove 13 near the bottom. The wire 15 extends the length of groove 13 and is flush with the front and back walls 9 of body 3. The wire is 0.0007"–0.003" in diameter. The diameter of the fuse element is chosen to correspond to a desired melting time at a specified current level. A thin fuse element will melt or break at a lower current level than will a thicker fuse element. Further, the thin fuse element will break more quickly than a thick fuse element at the same current levels. Fuse element 15 is made as a wire or ribbon from electrically conductive materials such as copper, silver, or copper or silver alloys. Other materials include, but are not limited to, platinum, gold, palladium, tungsten, rubidium, nickel, aluminum, or their alloys.

The wire 15 is positioned to be below the surface of the chip and to be in contact with, or close proximity to, the bottom of the groove. Groove 13 thus provides an offset for the fuse element so it can be positioned away from the surface 5 of the fuse 1 to isolate the fuse element 13 from the PC board.

Groove 13 also provides a guide for the fuse element 15, making assembly of the fuse 1 easier. If groove 13 is much wider than 0.032" it will not provide necessary control for the placement of wire 15. This will increase the difficulty of obtaining the necessary control for the length and resistance of the fuse element 15. The groove, by offsetting the fuse element from the body surface 5, further provides a cavity which can contain the high pressure and temperature created by the fuse element during fuse interruption. The groove 13 thus provides protection to the PC board on which fuse 1 is mounted and the components surrounding the fuse when the fuse blows.

A liquid thick film paste or ink of metallized material is deposited inside the groove adjacent front and back walls 9 to secure fuse element 15 in groove 13 and to form spaced apart terminations or terminals 17. The thick film ink can be purchased from ESI Co. of Pennsylvania. The ink is preferably a silver ink. The ink paste is preferably deposited by thick film or screen printing. This method allows for accurate control of the placement of the ink in groove 13 and of the thickness of the ink covering body surface 5. Other paste dispensing techniques, such as syringe applicator, needle deposit, and the like, can also be use. However, such techniques were found to be less accurate and required significantly longer deposition time and used 4–5 times as much material, leading to a much higher cost of the final product.

Figure 3:
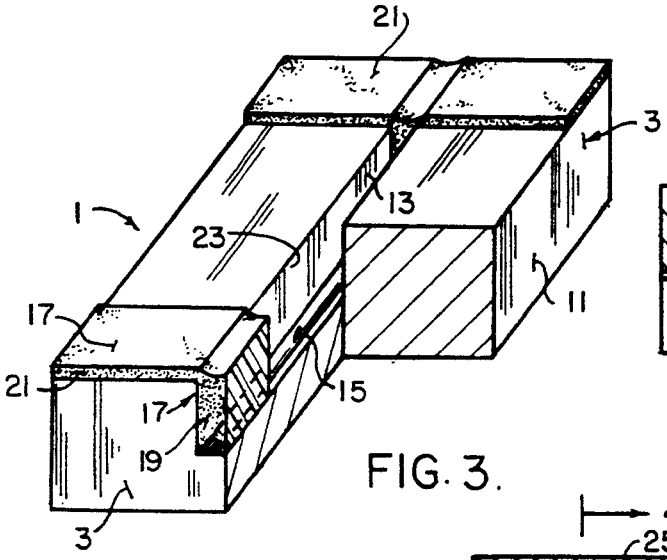
FIG. 3 is a perspective view of the fuse, partially cut away.

The terminal 17, as shown, forms a T having a stem 19 which fills groove 13 and a flange portion 21 which overlies surface 5 of body 3. The stem 19 envelopes the wire 15, as shown in FIG. 3, to provide a good electrical contact between the wire and terminal and to secure wire 15 in body 3. It has been found that if groove 13 is much deeper than 0.016" the metal ink will not flow to the bottom of the groove to obtain secure connection to the fuse element 15.

After printing, the ink paste is dried and fired to form metallized areas 17 which provide secure connection for the conductor 15 and electrical termination 17 of the chip. The thick film inks that are fired on the substrates contain particles of metals and metal oxide, glass, a plastic binder and a solvent which makes the ink somewhat fluid. Each of the listed components have an important role. The inks used in the screening process are formulated to behave in a certain manner under screening conditions. This is accomplished with the use of very small particles typically averaging 0.2 mils in diameter. The solvent is provides viscosity to the ink. The ink is distributed by the pressure of the squeegee, sliding on the surface of the screen or stencil. The viscosity of the ink can change during the printing process. The resistance of the ink to an increasing shear force decreases. Thus when squeegee speed is increased the ink becomes more fluid. This phenomena is used to pass the ink through opening of the screens and wet the material in contact with a screen. The screen is released cleanly from the surface of the printed material and the ink quickly recovers to the original viscosity.

The ink is dried at temperature of 120–150° C. When it is dried it forms a film. The drying process is controlled to provide gradual evaporation of the solvent without boiling it. After drying the particles of ink material are bound together with a plastic-like ethylcellulose. After drying of one type of film another ink can be printed and tried as another layer. During firing heat decomposes the ethylcellulose and the ethylcellulose combines with the oxygen to form carbon dioxide and water vapor. When the temperature is elevated to above 480° C, the glass particles in the film start to melt and sink to the bottom of the film, the metal particles in the conductor film then begin to sinter, or join together. The bonding to a ceramic or glass dielectric of the metal film is accomplished when glass "freezes" and bonds the film to the substrate and bonds the particles together.

In order to provide secure attachment of a conductor, such as a fuse element, to the insulating means, the insulator thick film deposition and fuse element assembly is fired together at temperatures above 500° C.

The thick film metallizations such as silica, copper or gold, preferably of silver, are fired in air, or some other gases, such as nitrogen, hydrogen, or argon, to a full density composition. The fired and sintered materials normally contain by-products of organic matter produced after firing and include 1–2% carbon.

Figure 4:
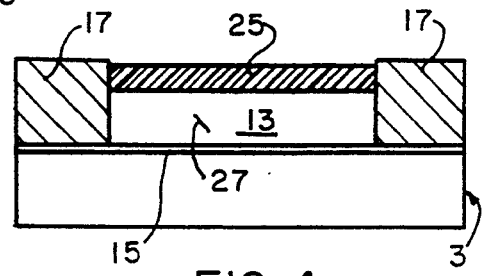
FIG. 4 shows a longitudinal cross-sectional view of a time delay fuse made according to the present invention taken along line 4—4 of FIG. 5.
Figure 5:
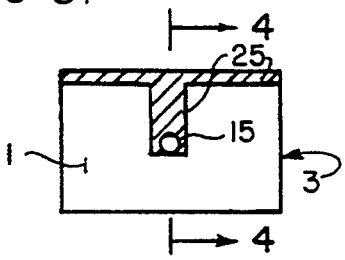
FIG. 5 is an end elevational view of the time delay fuse.

The terminals 17 are spaced from each other, leaving a gap 23 in groove 13 which is open. The gap 23 is filled with a dielectric paste which when dried forms a high mechanical strength, hermetic seal 25 which extends between terminals 17. Seal 25 is preferably made of ceramic or glass. Again, thermoplastic materials are not used. In FIGS. 4 and 5, the seal 25 is spaced above the wire 15 defining void or cavity 27 around wire 15. Cavity 27 isolates fuse element 15 from direct contact with the thermally conductive ceramic or glass material of seal 25. The air or gas which fills cavity 27 has a significantly lower thermal conductivity than the seal. The lower thermal conductivity of the gas gives the fuse of FIGS. 4 and 5 a time delay.

The time delay fuses can be separated into two types. A first type of time delay provides for a longer opening time at a current of 3–20 times of the fuse's rating. A second type of time delay provides for longer opening times at overloads of 1.5–3 times of the fuse's current rating. The first type of time delay fuse can be use to protect against high overloads. Fuses having such time delays are used to provide uninterruptable service for circuits which experience very high surges during normal operation. Such fuses are frequently used in telecommunication industries. The second type of time delay fuse provides protection for low overloads, and is frequently used to avoid premature opening of the fuse during normal startup when current values will not exceed 2–3 times of the nominal value of the circuit current. The type of time delay fuse formed depends in part on the thickness of the fuse element and the material from which it is made.

Figure 6:
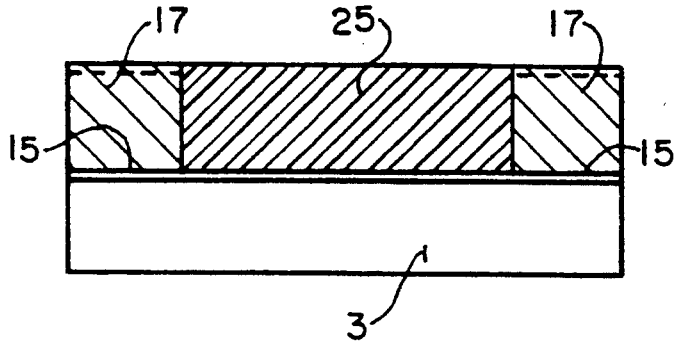
FIG. 6 is a longitudinal cross-sectional view of a fast acting fuse made in accordance with the present invention taken along line 7—7 of FIG. 7.
Figure 7:
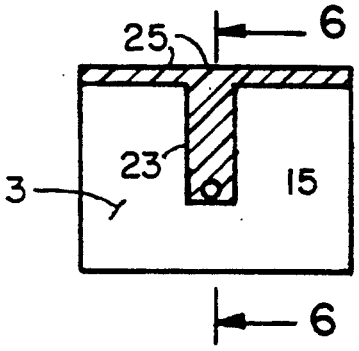
FIG. 7 is an end elevational view of the fast acting fuse.

The fuse of FIGS. 6 and 7 has a seal 25 which fills the gap 23 and covers the fuse element 15. This provides for a fuse which will open very fast at high overload and time delay overloads of 1.5–3 times the fuse rating.

Figure 8:
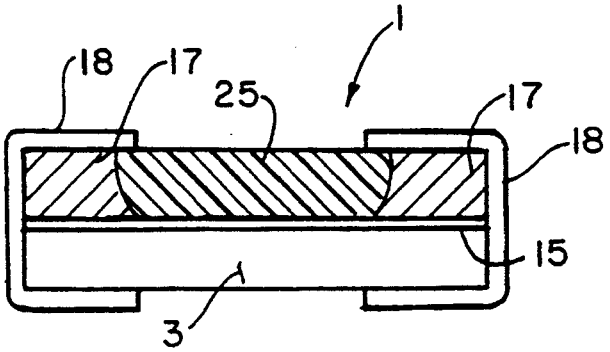
FIG. 8 is a longitudinal cross-sectional view of the fuse with wrap around terminations.

FIG. 8 shows the fuse of FIGS. 6 and 7 with the terminal 17 modified to form a wrap around terminal 18. The use of a wrap around terminal allows for easier surface mounting of chip fuse 1 to a PC board.

Unlike the prior fuses, the attachment of the fuse by depositing ink directly on the fuse element does not require any prior metallization of the body or wire. One of the functions of thick film in this case is to provide secure termination for the fuse itself. Another function of the thick film attachment is to create an enclosure for the fuse element. The volume occupied by a thick film paste after it has been fired inside the groove creates a pair of plugs or sealed barriers on each side of the fuse element disposed inside the groove. The space between the terminals is filled with a dielectric coating to form a seal. The seal may be formed to be spaced above wire 15, or to cover the wire, to form a time delay fuse or a fast acting fuse.

The fuses can be manufactured as a single unit or preferably for mass production by utilizing a large substrate containing several hundred chips. In such cases, the chips can be separated at their sides 9 and 11 by using a dicing or laser scribing and breaking techniques. The ends of the wires 5 are extended to be in the same plane as the edges of the chip 3.

While the invention has been described with reference to a preferred embodiment, it will be understood by those skilled in the art that various changes can be made and equivalents may be substituted for elements thereof without departing from the scope of the invention. Therefore, it is intended that the broad claims of the invention not to be limited to a particulate embodiment disclosed herein as the best mode contemplate for carrying out the invention should not be limited to such detail.

I claim:

1. A fuse comprising:

a body made of an electrical insulating material and having a top, a bottom, a front , a back, and sides; the body defining at least one elongate groove in the top and extending between said front and said back;

a fuse element received in said at least one groove in proximity to a bottom of said at least one groove, said fuse element extending substantially the full length of said at least one groove;

a pair of spaced metal fillings defining terminals received in said at least one groove to be in mechanical and electrical contact with said fuse element to secure said fuse element in said at least one groove; and a seal of dielectric material extending between said terminals in said at least one groove.

2. The fuse of the claim 1 wherein said seal has a lower surface, said lower surface being spaced from said fuse element such that said seal, said at least one groove, and said terminals define a closed cavity.

3. The fuse of claim 1 wherein said seal encases said fuse element.

4. The fuse of claim 1 wherein said at least one groove has a depth of less than 0.20" and a width of between 0.004" and 0.20".

5. The fuse of claim 4 wherein said at least one groove has a depth of about 0.016".

6. The fuse of claim 5 wherein said at least one groove, has a constant depth.

7. The fuse of claim 4 wherein said at least one groove has a width of 0.006"–0.032".

8. The fuse of claim 1 wherein said fuse element has ends which are flush with the said front and back of said body.

9. The fuse of claim 1 wherein said fuse element is formed as a wire or ribbon.

10. The fuse of claim 9 wherein said wire is made of an electrically conductive material chosen from the group consisting of copper, silver, platinum, gold, palladium, rubidium, nickel, tungsten, aluminum, and their alloys.

11. The fuse of claim 1 wherein said fuse is metallized around its opposing edges to provide wrap-around termination.

12. The fuse of the claim 11 wherein said fuse metal fillings are coated with solderable coating.

13. A fuse comprising:

an elongated electrical insulating body of rectangular shape and having a surface thereon, said body having at least one elongate groove connecting two opposing edges of said insulating body;

a fuse element placed inside the said at least one groove in proximity to the bottom of said at least one groove and extending the length of said at least one groove; and at least two space metal fillings, deposited in said at least one groove on opposite ends of said at least one groove to provide termination for said fuse and to mechanically secure said fuse element in place in said fuse body, said fillings extending into contiguity and overlying with said body surface to provide exposed termination for said fuse.

14. The fuse of claim 13 wherein said meal fillings are in contact with a bottom edge of the said at least one groove.

15. The fuse of claim 14 wherein said metal fillings are bonded to said fuse body.

16. A method of forming a .surface mountable fuse comprising:

providing a body defining a groove connecting two opposing edges of said body;

placing a fuse element in said groove, said fuse element extending substantially the full width of said groove;

forming spaced metal terminals at opposite ends of said groove to secure said fuse element in said body and to provide for electrical termination of said fuse to allow for electrical connection of said fuse to a component; and forming a seal for said groove between said spaced metal terminals.

17. The method of claim 16 wherein said terminal forming step includes filling opposite ends of said groove with a metallic ink; drying said ink; and firing said ink.

18. The method of claim 17 wherein said ink includes a solvent, said drying process being controlled to evaporate said solvent without boiling said solvent.

19. The method of claim 18 wherein said drying step is performed at 120° C. –150° C.

20. The method of claim 17 wherein said metal filling is sintered to said fuse element and said fuse body.

21. The method of claim 20 wherein said step of sintering is performed during said firing step.

22. The method of claim 21 wherein said firing step is performed at a temperature of at least 500° C.

23. The method of claim 17 wherein said step of forming said seal provides a gap between said seal and said fuse element.

24. The method of claim 17 wherein said step of forming said seal includes filling said groove between said metal fillings with a dielectric material which encapsulates said fuse element.

* * * * *

UNITED STATES PATENT AND TRADEMARK OFFICE

CERTIFICATE OF CORRECTION

PATENT NO. : 5,363,082

DATED : November 8, 1994

INVENTOR(S) : Leon Gurevich

It is certified that error appears in the above-indentified patent and that said Letters Patent is hereby corrected as shown below:

Column 8, line 8, change "meal" to --metal--.

Signed and Sealed this

Seventh Day of February, 1995

*Attest:*

*Attesting Officer*

BRUCE LEHMAN

*Commissioner of Patents and Trademarks*